US010222818B1

(12) United States Patent
Lin

(10) Patent No.: US 10,222,818 B1
(45) Date of Patent: Mar. 5, 2019

(54) PROCESS AND TEMPERATURE TRACKING REFERENCE VOLTAGE GENERATOR

(71) Applicant: Realtek Semiconductor Corp., Hsinchu (TW)

(72) Inventor: Chia-Liang (Leon) Lin, Fremont, CA (US)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 0 days.

(21) Appl. No.: 16/039,379

(22) Filed: Jul. 19, 2018

(51) Int. Cl.
*G05F 1/10* (2006.01)
*G05F 3/26* (2006.01)

(52) U.S. Cl.
CPC ..... *G05F 3/262* (2013.01)

(58) Field of Classification Search
CPC . G05F 3/262; G05F 3/242; G05F 1/46; G05F 1/461; G05F 1/462; G05F 1/56; G05F 1/567; G05F 1/562; G05F 1/561; G05F 1/59; G05F 1/595; G11C 5/147
See application file for complete search history.

(56) References Cited

U.S. PATENT DOCUMENTS 5,422,563 A * 6/1995 Pflueger ..... G05F 1/575 323/312
5,453,679 A * 9/1995 Rapp ..... G05F 3/30 323/313
8,212,545 B2 * 7/2012 Imura ..... G05F 3/24 323/313
9,525,407 B2 * 12/2016 Iriarte ..... H03K 5/2472
9,632,521 B2 * 4/2017 Iriarte ..... G05F 3/242

* cited by examiner

*Primary Examiner* — An T Luu
(74) *Attorney, Agent, or Firm* — McClure, Qualey & Rodack, LLP

(57) ABSTRACT

A circuit including a first PMOS (p-channel metal oxide semiconductor) transistor, a first NMOS (n-channel metal oxide semiconductor) transistor, a second PMOS transistor, and a second NMOS transistor. A source, a gate, and a drain of the first PMOS transistor connect to a first node, a second node, and a third node, respectively. A source, a gate, and a drain of the first NMOS transistor connect to a fourth node, the third node, and the second node, respectively. A source, a gate, and a drain of the second PMOS transistor connect to the third node, the fourth node, and the second node, respectively. Finally, a source, a gate, and a drain of the second NMOS transistor connect to the second node, the first node, and the third node, respectively.

9 Claims, 4 Drawing Sheets

PROCESS AND TEMPERATURE TRACKING REFERENCE VOLTAGE GENERATOR

BACKGROUND OF THE INVENTION

Field of the Invention

The present invention generally relates to reference voltage generators and more particularly to reference voltage generators that effectively track all corners of a CMOS process.

Description of Related Art

A speed of a circuit (for instance, inverter) fabricated using a CMOS (complementary metal oxide semiconductor) process technology is usually highly dependent on PVT (manufacturing Process, supply Voltage, junction Temperature). The supply voltage is relatively easier to control, compared to (manufacturing) process and (junction) temperature. Therefore, circuit designers often choose to adjust the supply voltage of the circuit to maintain a desired speed for the circuit. To establish a steady supply voltage, a voltage regulator is often used, wherein the supply voltage is controlled in a closed-loop manner to track a reference voltage. In this case, circuit designers typically adjust the reference voltage in accordance with the process and the temperature, so that the supply voltage is adjusted for the circuit to maintain a desired speed despite a variation of the process and the temperature. Since a circuit works faster at a higher supply voltage, raising the reference voltage (and thus the supply voltage) is an effective method to remedy a speed reduction due to a process and/or temperature variation. However, raising the reference voltage (and thus the supply voltage) will increase power consumption, which is a trade-off typically made to maintain the desired speed. On the other hand, lowering the reference voltage (and thus the supply voltage) will reduce power consumption. Therefore, it is desirable to lower the reference voltage (and thus the supply voltage) when encountering a speed increase due to a process and/or temperature variation.

As is known, a CMOS process has five corners: TT (typical-typical), wherein both NMOS (n-channel metal oxide semiconductor) transistors and PMOS transistors (p-channel metal oxide semiconductor) are typical in speed; SS (slow-slow), wherein both NMOS transistors and PMOS transistors are slow; FF (fast-fast), wherein both NMOS transistors and PMOS transistors are fast; FS (fast-slow), wherein NMOS transistors are fast but PMOS transistors are slow; and SF (slow-fast), wherein NMOS transistors are slow but PMOS transistors are fast. It is desired that: the supply voltage is set higher in the SS, the FS, and the FS corners (than in the TT corner) to ensure the both NMOS transistors and PMOS transistors can be at least as fast as they are in the TT corner, and is set lower in the FF corner (than in the TT corner) to reduce a power consumption. If the supply voltage is set in accordance with the process corner in this manner, the supply voltage is said to be process tracking.

The temperature also has a profound impact on speed of MOS devices. PMOS transistors and NMOS transistors all become slower as the temperature rises and faster as the temperature falls. If the supply voltage is adjusted in accordance with the temperature, so that PMOS transistors and NMOS transistors can maintain approximately their speeds regardless of a change of the temperature, the supply voltage is said to be temperature tracking.

It is desirable to have a process and temperature tracking reference voltage, so that the supply voltage of the circuit can be process and temperature tracking. This way, the circuit can fulfill a desired speed despite a variation of the process and the temperature, and doesn't need to waste power in a case where the devices are already sufficiently fast.

Inverters are widely used to characterize device speed in a CMOS chip. As shown in FIG. 1, a reference voltage generator 100 comprises a current source 110 configured to output a reference current $V_{REF}$, and a reference load 120 configured to convert the reference current $I_{REF}$ into a reference voltage $V_{REF}$. The reference load 120 is a self-biasing inverter comprising a PMOS transistor 121 and a NMOS transistor 122. Here, "$V_{DD}$" denotes a power node. PMOS transistor 121 is configured in a diode-connect topology wherein its gate and its drain are connected. NMOS transistor 122 is also configured in a diode-connect topology wherein its gate and its drain are connected. The reference voltage $V_{REF}$ is tapped at the source of PMOS transistor 121.

By applying the square law model (which is well known to those of ordinary skill in the art, and thus not explained in detail here) for MOS transistors, the following two equations are used to represent PMOS transistor 121 and NMOS transistor 122, respectively:

$$I_{REF} \approx \frac{\mu_p C_{ox} W_p (V_{REF} - V_{MID} - V_{thp})^2}{2L_p} \tag{1}$$

$$I_{REF} \approx \frac{\mu_n C_{ox} W_n (V_{MID} - V_{thn})^2}{2L_n} \tag{2}$$

Here, $V_{thp}$, $W_p$, and $L_p$ are the threshold voltage, the width, and the length, respectively, for PMOS transistor 121; $V_{thn}$, $W_n$, and $L_n$ are the threshold voltage, the width, and the length, respectively, for NMOS transistor 122; $C_{ox}$ is the gate oxide capacitance per unit area; $\mu_n$ is mobility of electrons; $\mu_p$ is mobility of holes; and $V_{MID}$ denotes the voltage at the drain of PMOS transistor 121, which is also the voltage at the drain of NMOS transistor 122. Note that in some literature, the threshold voltage of a PMOS transistor is defined with respect to gate-to-source voltage and thus is negative. Here, the threshold voltage of a PMOS transistor is defined with respect to source-to-gate voltage and thus is positive. It is merely a matter of convention and does not alter the underlying physical principle.

Equations (1) and (2) must be satisfied in all corners. In practice, $V_{thp}$, $V_{thn}$, and $C_{ox}$ are highly process dependent. As well, $V_{thp}$, $V_{thn}$, $\mu_p$, and $\mu_n$ are highly temperature dependent. For simplicity, assume that the temperature is fixed at a room temperature, while the process is subject to variation. In the TT corner, each of $V_{thp}$, $V_{thn}$, and $C_{ox}$ has a respective nominal value. Accordingly, each of $V_{REF}$ and $V_{MID}$ has a respective nominal value so that equations (1) and (2) can be satisfied in the TT corner. In the SS corner, $V_{thn}$ and $V_{thp}$ are higher and $V_{ox}$ is lower (compared to their respective nominal values); in this case, both $V_{REF}$ and $V_{MID}$ must be higher (compared to their respective nominal values) otherwise equations (1) and (2) cannot be satisfied. In the FF corner, $V_{thn}$ and $V_{thp}$ are lower and $V_{ox}$ is higher (compared to their respective nominal values); in this case, both $V_{REF}$ and $V_{MID}$ must be lower (compared to their respective nominal values) otherwise equations (1) and (2) cannot be satisfied. In the FS corner, $V_{thn}$ is (for instance) 100 mV below nominal, $V_{thp}$ is (for instance) 100 mV above nominal, and $C_{ox}$ is the same as nominal.

To satisfy equations (1) and (2), $V_{MID}$ must be below nominal by approximately 100 mV, but $V_{REF}$ must be approximately the same as nominal. In this case, the circuit that receives a supply voltage referenced to $V_{REF}$ may not work adequately well since the PMOS transistors therein may be too slow. In the SF (slow-fast) corner, $V_{thn}$ is (for instance) 100 mV above nominal, $V_{thp}$ is (for instance) 100 mV below nominal, and $C_{ox}$ is the same as nominal. To satisfy equations (1) and (2), $V_{MID}$ must be higher than nominal by approximately 100 mV, but $V_{REF}$ must be approximately the same as nominal. In this case, the circuit that receives a supply voltage referenced to $V_{REF}$ may not work adequately well since the NMOS transistors therein may be too slow. Therefore, reference voltage generator 100 does not effectively track the FS corner or the SF corner.

What is desired is a reference voltage generator that can track all corners.

BRIEF SUMMARY OF THIS INVENTION

In an embodiment, a circuit comprises: a first PMOS (p-channel metal oxide semiconductor) transistor, a first NMOS (n-channel metal oxide semiconductor) transistor, a second PMOS transistor, and a second NMOS transistor, wherein: a source, a gate, a drain of the first PMOS transistor connect to a first node, a second node, and a third node, respectively; a source, a gate, and a drain of the first NMOS transistor connect to a fourth node, the third node, and the second node, respectively; a source, a gate, and a drain of the second PMOS transistor connect to the third node, the fourth node, and the second node, respectively; and a source, a gate, and a drain of the second NMOS transistor connect to the second node, the first node, and the third node, respectively. In an embodiment, the circuit further comprises: a current source configured to output a reference current to the first node. In an embodiment, the circuit further comprises: a voltage regulator configured to receive a voltage at an output terminal of the current source and output a supply voltage at a regulated node, and a load circuit configured to receive power from the regulated node.

In an embodiment, a circuit comprises: a current source configured to output a reference current; a reference load network configured to receive the reference current via a primary NMOS (n-channel metal oxide semiconductor) transistor configured in a diode-connect topology; a source follower embodied by a secondary NMOS transistor configured to receive a control voltage established at a gate of the primary NMOS transistor and output a supply voltage to a regulated node; and a load circuit configured to receive power from the regulated node. The reference load network comprises: a first PMOS (p-channel metal oxide semiconductor) transistor, a first NMOS transistor, a second PMOS transistor, and a second NMOS transistor, wherein: a source, a gate, a drain of the first PMOS transistor connect to a first node, a second node, and a third node, respectively; a source, a gate, and a drain of the first NMOS transistor connect to a fourth node, the third node, and the second node, respectively; a source, a gate, and a drain of the second PMOS transistor connect to the third node, the fourth node, and the second node, respectively; and a source, a gate, and a drain of the second NMOS transistor connect to the second node, the first node, and the third node, respectively.

DETAILED DESCRIPTION OF THIS INVENTION

The present invention relates to reference voltage generation. While the specification describes several example embodiments of the invention considered favorable modes of practicing the invention, it should be understood that the invention can be implemented in many ways and is not limited to the particular examples described below or to the particular manner in which any features of such examples are implemented. In other instances, well-known details are not shown or described to avoid obscuring aspects of the invention.

Persons of ordinary skill in the art understand terms and basic concepts related to microelectronics that are used in this disclosure, such as "circuit," "load," "voltage," "current," "resistor," "capacitor," "low-pass filter," "transistor," "MOS (metal-oxide semiconductor)," "PMOS (p-channel metal oxide semiconductor)," "NMOS (n-channel metal oxide semiconductor)," "CMOS (complementary metal oxide semiconductor)," "node," "power supply," "voltage regulator," "operational amplifier," "source," "gate," "drain," "ground node," "power node," "serial connection," "current source," "diode-connect," "source follower," and "current mirror." Those of ordinary skill in the art can also readily recognize a symbol of a MOS transistor, and its associated "source," "gate," and "drain" terminals. Terms and basic concepts like these are apparent to those of ordinary skill in the art and thus will not be explained in detail here.

Figure 1:
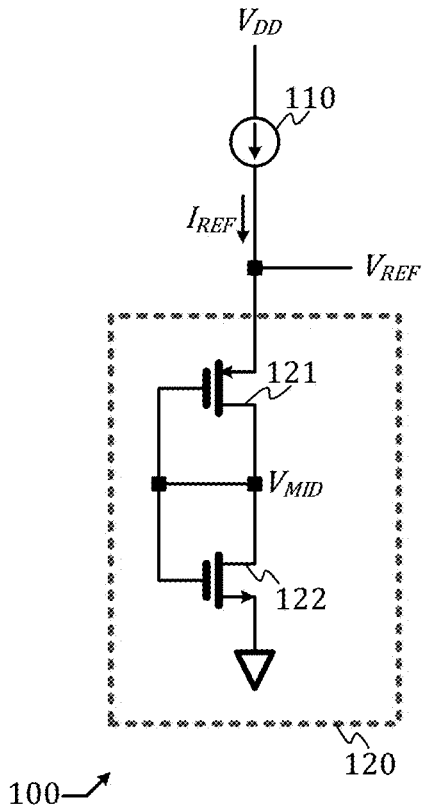
FIG. 1 (PRIOR ART)
FIG. 1 shows a schematic diagram of a prior art reference voltage generator.
Figure 2:
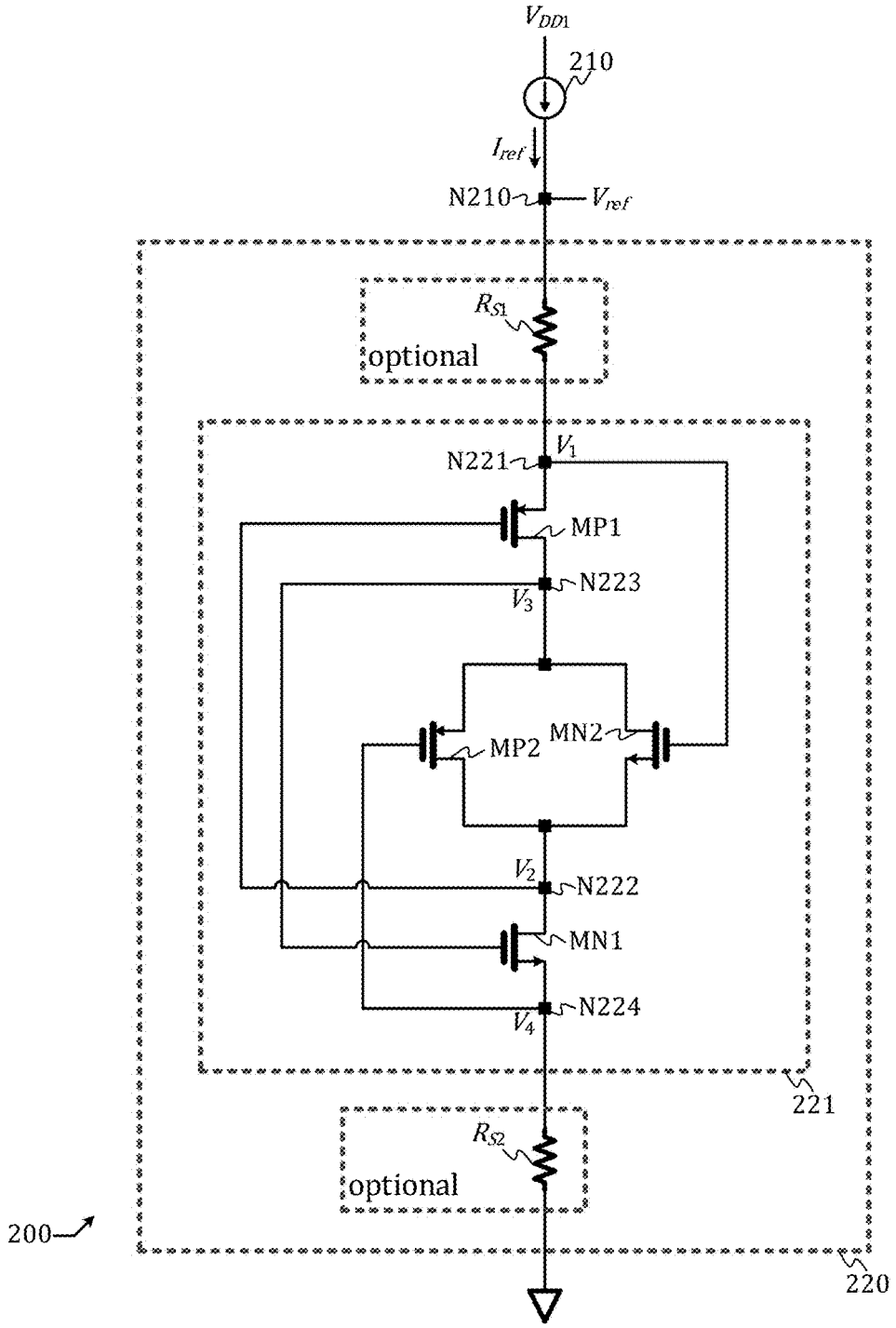
FIG. 2 shows a schematic diagram of a reference voltage generator in accordance with an embodiment of the present invention.

A schematic diagram of a reference voltage generator 200 in accordance with an embodiment of the present invention is depicted in FIG. 2. Reference voltage generator 200 comprises: a current source 210 configured to output a reference current $I_{ref}$; and a reference load network 220, which comprises a serial connection of a first optional resistor $R_{S1}$, an active load 221, and a second optional resistor $R_{S2}$, configured to receive the reference current $I_{ref}$ and establish a reference voltage $V_{ref}$ at a reference node N210. Here, "$V_{DD1}$" denotes a first power node. The active load 221 comprises a first PMOS transistor MP1, a first NMOS transistor MN1, a second PMOS transistor MP2, and a second NMOS transistor MN2. The source, the gate, and the drain of PMOS transistor MP1 connect to a first node N221, a second node N222, and a third node N223, respectively. The source, the gate, and the drain of NMOS transistor MN1 connect to a fourth node N224, the third node N223, and the second node N222, respectively. The source, the gate, and the drain of PMOS transistor MP2 connect to the third node N223, the fourth node N224, and the second node N222, respectively. The source, the gate, and the drain of NMOS transistor MN2 connect to the second node N222, the first node N221, and the third node N223, respectively. The voltage at the first (second, third, fourth) node N221 (N222, N223, N224) is denoted as $V_1$ ($V_2$, $V_3$, $V_4$). Let the width and length of PMOS transistor MP1 be $W_{p1}$ and $L_{p1}$, respectively. Let the width and length of PMOS transistor MP2 be $W_{p2}$ and $L_{p2}$, respectively. Let the width and length of NMOS transistor MN1 be $W_{n1}$ and $L_{n1}$, respectively. Let the width and length of NMOS transistor MN2 be $W_{n2}$ and $L_{n2}$, respectively. Let the threshold voltage for PMOS transistors MP1 and MP2 be $V_{thp}$. Let the threshold voltage for NMOS transistors MN1 and MN2 be $V_{thn}$. Here, it is assumed that all PMOS transistors have the same threshold voltage, and all NMOS transistors have the same threshold voltage; this assumption is not absolutely necessary, but provides for easier explanation for the present invention. In practice, all PMOS transistors may not have the same threshold voltage, but their threshold voltages will be highly correlated. Likewise, all NMOS transistors may not have the same threshold voltage, but their threshold voltages will be highly correlated. Granted that all MOS transistors of the same type have threshold voltages that are highly correlated, the present invention can work well despite the threshold voltages may not be the same.

A purpose of the reference load network 220 is to make $V_{ref}$ process and temperature tracking. Throughout this disclosure, "process" means "manufacturing process of CMOS devices." The process dependency is discussed first, and the temperature is assumed to be fixed at a room temperature for now. Later the temperature dependency will be discussed.

By applying the square law model for MOS transistors and neglecting channel-length modulation, the following three equations must hold in all corners:

$$I_{ref} \approx \frac{\mu_p C_{ox} W_{p1}(V_1 - V_2 - V_{thp})^2}{2L_{p1}} \tag{3}$$

$$I_{ref} \approx \frac{\mu_n C_{ox} W_{n1}(V_3 - V_4 - V_{thn})^2}{2L_{n1}} \tag{4}$$

$$I_{ref} \approx \frac{\mu_n C_{ox} W_{n2}(V_1 - V_2 - V_{thn})^2}{2L_{n2}} + \frac{\mu_p C_{ox} W_{p2}(V_3 - V_4 - V_{thp})^2}{2L_{p2}} \tag{5}$$

Equation (3) is based on that the drain current of PMOS transistor MP1 must be equal to $I_{ref}$. Equation (4) is based on that the drain current of NMOS transistor MN1 must be equal to $I_{ref}$. Equation (5) is based on that a sum of the drain current of PMOS transistor MP2 and the drain current of NMOS transistor MN2 must be equal to $I_{ref}$. Note that the values of $V_{thp}$, $V_{thn}$, and $C_{ox}$ are all highly process dependent, but the value of $I_{ref}$ is determined by the current source 210 and substantially independent of the manufacturing process of the MOS devices.

In an embodiment, a width-to-length ratio of PMOS transistor MP2 is approximately equal to a width-to-length ratio of NMOS transistor MN2; this arrangement is not absolutely needed, but helps to limit an imbalance of the active load 221 in a skew corner (i.e. FS or FS). In an embodiment, a width-to-length ratio of PMOS transistor MP1 is approximately equal to a width-to-length ratio of NMOS transistor MN1; again, this arrangement is not absolutely needed, but helps to limit an imbalance of the active load 221 in a skew corner (i.e. FS or FS).

The value of $V_{thp}$ ($V_{thn}$, $C_{ox}$) in the TT corner at the room temperature is said to be the nominal value of $V_{thp}$ ($V_{thn}$, $C_{ox}$). In a case where the value of $V_{thp}$ ($V_{thn}$, $C_{ox}$) is larger than the nominal value of $V_{thp}$ ($V_{thn}$, $C_{ox}$), it is said that $V_{thp}$ ($V_{thn}$, $C_{ox}$) is above nominal. In a case where the value of $V_{thp}$ ($V_{thn}$, $C_{ox}$) is smaller than the nominal value of $V_{thp}$ ($V_{thn}$, $C_{ox}$), it is said that $V_{thp}$ ($V_{thn}$, $C_{ox}$) is below nominal. The value of $V_1$ ($V_2$, $V_3$, $V_4$) in the TT corner at the room temperature is said to be the nominal value of $V_1$ ($V_2$, $V_3$, $V_4$). In a case where the value of $V_1$ ($V_2$, $V_3$, $V_4$) is larger than the nominal value of $V_1$ ($V_2$, $V_3$, $V_4$), it is said that $V_1$ ($V_2$, $V_3$, $V_4$) is above nominal. In a case where the value of $V_1$ ($V_2$, $V_3$, $V_4$) is smaller than the nominal value of $V_1$ ($V_2$, $V_3$, $V_4$), it is said that $V_1$ ($V_2$, $V_3$, $V_4$) is below nominal.

$V_1-V_4$, the voltage across the active load 221, can be expressed in the following form:

$$V_1-V_4=(V_1-V_2-V_{thp})+(V_3-V_4-V_{thn})+(V_{thp}V_{thn})-(V_3-V_2) \tag{6}$$

There are four terms on the right-hand side of equation (6). Consider a FS corner where $V_{thn}$ is 100 mV below nominal, $V_{thp}$ is 100 mV above nominal, and $C_{ox}$ is nominal. The third term ($V_{thp}+V_{thn}$) will be the same as nominal. The first term ($V_1-V_2-V_{thp}$) must be the same as nominal, as demanded by equation (3). The second term ($V_3-V_4-V_{thn}$) also must be the same as nominal, as demanded by equation (4). So, the value of $V_1$ hinges on the fourth term ($V_3-V_2$). Note that equation (4) demands that $V_3-V_4$ must be approximately 100 mV below nominal, while equation (3) demands that $V_1-V_2$ must be approximately 100 mV above nominal. Therefore, $V_3-V_4-V_{thp}$ must be approximately 200 mV below nominal, while $V_1-V_2-V_{thn}$ must be approximately 200 mV above nominal. Now, refer to equation (5). The $$\frac{\mu_n C_{ox} W_{n2}(V_1 - V_2 - V_{thn})^2}{2L_{n2}}$$

term will be larger than nominal and the $$\frac{\mu_p C_{ox} W_{p2}(V_3 - V_4 - V_{thp})^2}{2L_{p2}}$$

term will be smaller than nominal. The $$\frac{\mu_n C_{ox} W_{n2}(V_1 - V_2 - V_{thn})^2}{2L_{n2}}$$

term is a quadratic function with the argument $V_1-V_2-V_{thn}$, which is approximately 200 mV above nominal. The $$\frac{\mu_p C_{ox} W_{p2}(V_3 - V_4 - V_{thp})^2}{2L_{p2}}$$

term is a quadratic function with the argument $V_3-V_4-V_{thp}$, which is approximately 200 mV below nominal. A value of a quadratic function increases more rapidly when its argument increases than it decreases when its argument decreases. Therefore, the amount of increase of the $$\frac{\mu_n C_{ox} W_{n2}(V_1 - V_2 - V_{thn})^2}{2L_{n2}}$$

term (from its nominal value) will be greater than the amount of decrease of the $$\frac{\mu_p C_{ox} W_{p2}(V_3 - V_4 - V_{thp})^2}{2L_{p2}}$$

term (from its nominal value). Therefore, the sum of $$\frac{\mu_n C_{ox} W_{n2}(V_1 - V_2 - V_{thn})^2}{2L_{n2}}$$

and $$\frac{\mu_p C_{ox} W_{p2}(V_3 - V_4 - V_{thp})^2}{2L_{p2}}$$

will be larger than nominal and thus it is not possible for equation (5) to hold. That's because equation (5) does not consider channel-length modulation and overestimates the drain currents of PMOS transistor MP2 and NMOS transistor of MN2. To amend this problem, channel-length modulation must be considered, and $V_3-V_2$ must be smaller than nominal, so that the sum of the currents of PMOS transistor MP2 and NMOS transistor MN2 can be the same as nominal. From equation (6), it indicates that $V_1-V_4$ will be higher than nominal. Therefore, $V_1-V_4$ will be larger than nominal in the FS corner. So, $V_1-V_4$ can track the FS corner.

Consider a SF corner where $V_{thn}$ is 100 mV above nominal, $V_{thp}$ is 100 mV below nominal, and $C_{ox}$ is nominal. Now refer to the right-hand side of equation (6). The third term ($V_{thp}+V_{thn}$) will be the same as nominal. The first term ($V_1-V_2-V_{thp}$) must be the same as nominal, as demanded by equation (3). The second term ($V_3-V_4-V_{thn}$) also must be the same as nominal, as demanded by equation (4). So, the value of $V_1$ hinges on the fourth term ($V_3-V_2$). Note that equation (4) demands that $V_3-V_4$ must be approximately 100 mV above nominal, while equation (3) demands that $V_1-V_2$ must be approximately 100 mV below nominal. Therefore, $V_3-V_4-V_{thp}$ must be approximately 200 mV above nominal, while $V_1-V_2-V_{thn}$ must be approximately 200 mV below nominal. Now, refer to equation (5). The $$\frac{\mu_n C_{ox} W_{n2}(V_1 - V_2 - V_{thn})^2}{2L_{n2}}$$

term will be smaller than nominal and the $$\frac{\mu_p C_{ox} W_{p2}(V_3 - V_4 - V_{thp})^2}{2L_{p2}}$$

term will be larger than nominal. The $$\frac{\mu_n C_{ox} W_{n2}(V_1 - V_2 - V_{thn})^2}{2L_{n2}}$$

term is a quadratic function with the argument $V_1-V_2-V_{thn}$, which is approximately 200 mV below nominal. The $$\frac{\mu_p C_{ox} W_{p2}(V_3 - V_4 - V_{thp})^2}{2L_{p2}}$$

term is a quadratic function with the argument $V_3-V_4-V_{thp}$, which is approximately 200 mV above nominal. A value of a quadratic function increases more rapidly when its argument increases than it decreases when its argument decreases. Therefore, the amount of decrease of the $$\frac{\mu_n C_{ox} W_{n2}(V_1 - V_2 - V_{thn})^2}{2L_{n2}}$$

term (from its nominal value) will be smaller than the amount of increase of the $$\frac{\mu_p C_{ox} W_{p2}(V_3 - V_4 - V_{thp})^2}{2L_{p2}}$$

term (from its nominal value). Therefore, the sum of $$\frac{\mu_n C_{ox} W_{n2}(V_1 - V_2 - V_{thn})^2}{2L_{n2}}$$

and $$\frac{\mu_p C_{ox} W_{p2}(V_3 - V_4 - V_{thp})^2}{2L_{p2}}$$

will be larger than nominal and thus it is not possible for equation (5) to hold. That's because equation (5) does not consider channel-length modulation and overestimates the drain currents of PMOS transistor MP2 and NMOS transistor of MN2. To amend the issue, channel-length modulation must be considered, and $V_3-V_2$ must be smaller than nominal, so that the sum of the currents of PMOS transistor MP2 and NMOS transistor MN2 can be the same as nominal. From equation (6), it indicates that $V_1-V_4$ will be higher than nominal. Therefore, $V_1-V_4$ will be larger than nominal in the SF corner. So, $V_1-V_4$ can track the SF corner.

In a SS corner where both $V_{thp}$ and $V_{thn}$ are above nominal and $C_{ox}$ is below nominal, all the four transistors MP1, MN1, MP2, and MN2 are weaker than nominal and each needs a larger than nominal source-to-gate voltage (applicable to PMOS transistors) or gate-to-source voltage (applicable to NMOS transistors) to make their drain currents the same as nominal. This is not possible unless $V_1-V_4$ is larger than nominal. Therefore, $V_1-V_4$ must be larger than nominal and thus can track the SS corner.

In a FF corner where both $V_{thp}$ and $V_{thn}$ are below nominal and $C_{ox}$ is above nominal, all the four transistors MP1, MN1, MP2, and MN2 are stronger than nominal and each needs a smaller than nominal source-to-gate voltage (applicable to PMOS transistors) or gate-to-source voltage (applicable to NMOS transistors) to make its their drain current the same as nominal. This is not possible unless $V_1-V_4$ is smaller than nominal. Therefore, $V_1-V_4$ must be smaller than nominal and thus can track the FF corner.

In summary, $V_1-V_4$ will be larger than nominal in the SS, FS, and SF corners to ensure all devices are at least as fast as nominal. $V_1-V_4$ will be smaller than nominal in the FF corner so that all devices have the same speed as nominal. Therefore, $V_1-V_4$ can track all corners.

Now consider the temperature. Given a whatever corner, a device is always slower (faster) at a higher (lower) temperature due to a lower (higher) mobility (i.e. $\mu_p$ and $\mu_n$). This applies to all transistors regardless of their types. Therefore, an effect of an increase (decrease) of temperature is equivalent to a tilt of process toward the SS (FF) corner. Since $V_1-V_4$ can effectively track all corners, including the SS and the FF corners, it can also effectively track the temperature.

The reference voltage $V_{ref}$ is tapped from the reference node N210. The first optional resistor $R_{S1}$, if adopted, is inserted between the reference node N210 and the first node N221. The second optional resistor $R_{S2}$, if adopted, is inserted between the fourth node N224 and the ground node. It is clear that $$V_{ref}=V_1-V_4+I_{ref}(R_{S1}+R_{S2}) \quad (7)$$

Therefore, $V_{ref}$ is higher than $V_1-V_4$ by an offset voltage that can be controlled by a value of the first optional resistor $R_{S1}$ and a value of the second optional resistor $R_{S2}$. Since $V_1-V_4$ can effectively track all corners and the temperature, so can $V_{ref}$. When the first optional resistor $R_{S1}$ is not adopted, it is replaced by a short circuit, and $V_{ref}$ will be the same as $V_1$. When the second optional resistor $R_{S2}$ is not adopted, it is replaced by a short circuit, and $V_4$ will be 0V (since it is shorted to the ground node).

Figure 3:
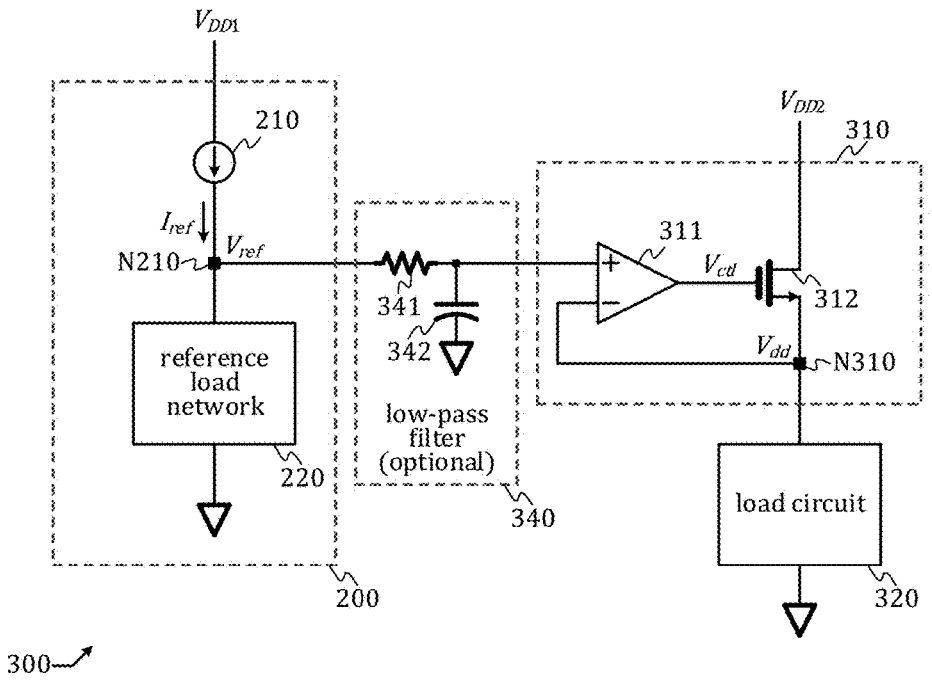
FIG. 3 shows a schematic diagram of an application circuit in accordance with an embodiment of the present invention.

A schematic diagram of an application circuit 300 of the reference voltage generator 200 of FIG. 2 is shown in FIG. 3. Application circuit 300 comprises the reference voltage generator 200 configured to output the reference voltage $V_{ref}$, a voltage regulator 310 configured to receive $V_{ref}$ (via the optional low-pass filter 340, if the low-pass filter 340 is adopted) and output a supply voltage $V_{dd}$ at a regulated node N310, and a load circuit 320 configured to receive power from the regulated node N310. Voltage regulator 310 comprises: an operational amplifier 311 configured to output a control voltage $V_{ctl}$ in accordance with a difference between the reference voltage $V_{ref}$ and the supply voltage $V_{dd}$, and a NMOS transistor 312 configured in a source follower topology to output the supply voltage $V_{dd}$ in accordance with the control voltage $V_{ctl}$. Here, "$V_{DD2}$" denotes a second power node. Voltage regulator 320 is widely used in the prior art and thus not described in detail here. Voltage regulator 310 adjusts the control voltage $V_{ctl}$ in a closed-loop manner to force the supply voltage $V_{dd}$ substantially equal to the reference voltage $V_{ref}$. Since $V_{ref}$ tracks process and temperature, as explained earlier, $V_{dd}$ also tracks process and temperature. The load circuit 320, therefore, can maintain adequate performance in all cases. Although in FIG. 3 the reference voltage generator 200 and the voltage regulator 310 receive power from different power nodes (i.e. the former from $V_{DD1}$ and the latter from $V_{DD2}$), it is an example but not limitation; circuit designers can choose to let them receive power from a common power node. The embodiment of the voltage regulator 310 shown in FIG. 3 is an example but not limitation, and those skilled in the art can choose to use a different circuit topology. For instance, a switching regulator can be used instead. In an optional embodiment a low-pass filter 340 is inserted between the reference voltage generator 200 and the voltage regulator 310, wherein the low-pass filter 340 comprises a serial resistor 341 and a shunt capacitor 342. Low-pass filter 340 can be adopted to suppress a noise of the reference voltage $V_{ref}$.

Figure 4:
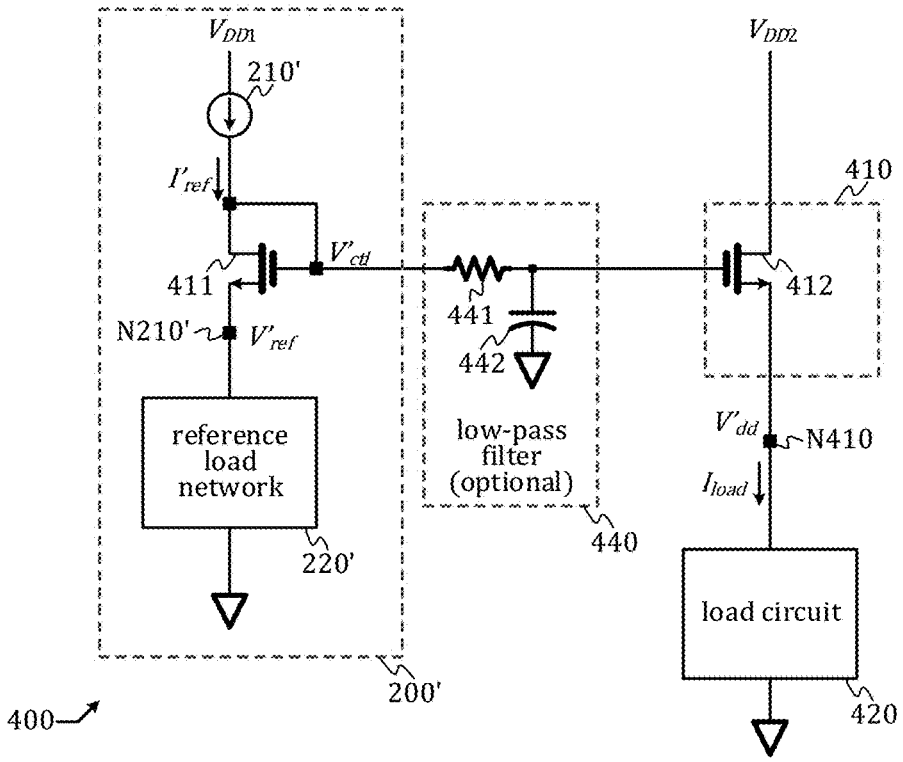
FIG. 4 shows a schematic diagram of an alternative application in accordance with an embodiment of the present invention.

A schematic diagram of an alternative application circuit 400 is shown in FIG. 4. The alternative application circuit 400 comprises: an alternative reference voltage generator 200' configured to output a control voltage $V'_{ctl}$, a source follower 410 configured to receive the control voltage $V'_{ctl}$ (via an optional low-pass filter 440, if the low-pass filter 440 is adopted) and output a supply voltage $V'_{dd}$ at a regulated node N410, and a load circuit 420 configured to receive power from the regulated node N410. The alternative reference voltage generator 200' comprises: a current source 210' configured to output a reference current $I'_{ref}$, and a reference load network 220' configured to receive the reference current $I'_{ref}$ via a primary NMOS transistor 411, which is configured in a diode-connect topology, and establish a reference voltage $V'_{ref}$ at a reference node N210'. Reference load network 220' is the same as reference load network 220 of FIG. 2, therefore, the reference voltage $V'_{ref}$ can track process and temperature. The alternative reference voltage generator 200' is the same as the reference voltage generator 200 of FIG. 2 except for having the primary NMOS transistor 411. Source follower 410 comprises a secondary NMOS transistor 412. The width-to-length ratio of the secondary NMOS transistor 412 is chosen to be larger than the width-to-length ratio of the primary NMOS transistor 411 by a factor approximately equal to a ratio between a load current $I_{load}$ of the load circuit 420 and the reference current $I'_{ref}$. For instance, the width-to-length ratio of the secondary NMOS transistor 412 is chosen to be ten times higher than the width-to-length ratio of the primary NMOS transistor 411 if the load current $I_{load}$ is approximately ten times larger than the reference current $I'_{ref}$. When the secondary NMOS transistor 412 is sized in this manner, the two NMOS transistors 411 and 412 effectively form a current mirror, and the supply voltage $V'_{dd}$ will be approximately the same as the reference voltage $V'_{ref}$. This way, there is no need for a voltage regulator.

Note that although each of transistors MP1, MN1, MP2, and MN2 appears to be a single transistor, those skilled in the art may choose to use a plurality of transistors to fulfill the same function as a single transistor. For instance, a single transistor of width of 10 μm and length of 1 μm is functionally equivalent to a serial connection of a first transistor and a second transistor, Each of width of 10 μm and length of 0.5 μm, wherein the gate of the first transistor is tied to the gate of the second transistor, and the source of the second transistor is tied to the drain of the first transistor. In this case, the source of the first transistor embodies the source of the equivalent single transistor, while the drain of the second transistor embodies the drain of the equivalent single transistor. Therefore, in the appended claims, "a source" is used in lieu of "the source" pertaining to a transistor, since in a practical embodiment a single transistor may not be literally a single transistor and there may not be a unique source terminal. Likewise, "a gate" is used in lieu of "the gate," and "a drain" is used in lieu of "the drain."

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A circuit comprising:

a first PMOS (p-channel metal oxide semiconductor) transistor, a first NMOS (n-channel metal oxide semiconductor) transistor, a second PMOS transistor, and a second NMOS transistor, wherein:

a source, a gate, a drain of the first PMOS transistor are connected to a first node, a second node, and a third node, respectively; a source, a gate, and a drain of the first NMOS transistor are connected to a fourth node, the third node, and the second node, respectively; a source, a gate, and a drain of the second PMOS transistor are connected to the third node, the fourth node, and the second node, respectively; and a source, a gate, and a drain of the second NMOS transistor are connected to the second node, the first node, and the third node, respectively.

2. The circuit of claim 1 further comprising a current source configured to output a reference current to the first node.

3. The circuit of claim 2 further comprising a voltage regulator configured to receive a voltage at an output terminal of the current source and output a supply voltage at a regulated node, and a load circuit configured to receive power from the regulated node.

4. The circuit of claim 1, wherein a width-to-length ratio of the first PMOS transistor is approximately equal to a width-to-length ratio of the first NMOS transistor.

5. The circuit of claim 1, wherein a width-to-length ratio of the second PMOS transistor is approximately equal to a width-to-length ratio of the second NMOS transistor.

6. A circuit comprising:

a current source configured to output a reference current;

a reference load network configured to receive the reference current via a primary NMOS (n-channel metal oxide semiconductor) transistor configured in a diode-connect topology;

a source follower embodied by a secondary NMOS transistor configured to receive a control voltage established at a gate of the primary NMOS transistor and output a supply voltage to a regulated node; and a load circuit configured to receive power from the regulated node, wherein the reference load network comprises: a first PMOS (p-channel metal oxide semiconductor) transistor, a first NMOS transistor, a second PMOS transistor, and a second NMOS transistor, wherein: a source, a gate, a drain of the first PMOS transistor are connected to a first node, a second node, and a third node, respectively; a source, a gate, and a drain of the first NMOS transistor are connected to a fourth node, the third node, and the second node, respectively; a source, a gate, and a drain of the second PMOS transistor are connected to the third node, the fourth node, and the second node, respectively; and a source, a gate, and a drain of the second NMOS transistor are connected to the second node, the first node, and the third node, respectively.

7. The circuit of claim 6, wherein a width-to-length ratio of the secondary NMOS transistor is larger than a width-to-length ratio of the primary NMOS by a factor approximately equal to a ratio between a current of the load circuit and the reference current.

8. The circuit of claim 6, wherein a width-to-length ratio of the first PMOS transistor is approximately equal to a width-to-length ratio of the first NMOS transistor.

9. The circuit of claim 6, wherein a width-to-length ratio of the second PMOS transistor is approximately equal to a width-to-length ratio of the second NMOS transistor.

* * * * *